US009004333B2

(12) United States Patent
Monaco et al.

(10) Patent No.: US 9,004,333 B2
(45) **Date of Patent: *Apr. 14, 2015**

(54) CASES AND COVERS FOR HANDHELD ELECTRONIC DEVICES

(71) Applicant: Eat Dirt, LLC, Orlando, FL (US)

(72) Inventors: Dean Monaco, Christmas, FL (US); John Santo, III, Orlando, FL (US)

(73) Assignee: Eat Dirt, LLC, Orlando, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/087,271

(22) Filed: Nov. 22, 2013

(65) Prior Publication Data

US 2014/0076750 A1 Mar. 20, 2014

Related U.S. Application Data

(62) Division of application No. 13/366,013, filed on Feb. 3, 2012, now Pat. No. 8,857,691, which is a division of application No. 12/748,765, filed on Mar. 29, 2010, now Pat. No. 8,485,404.

(51) Int. Cl.

| | |
|---|---|
| ***A45C 1/04*** | (2006.01) |
| ***A45F 3/00*** | (2006.01) |
| ***A45C 13/00*** | (2006.01) |
| ***A45C 11/00*** | (2006.01) |
| ***A45F 5/02*** | (2006.01) |
| ***H04R 1/02*** | (2006.01) |
| ***H04R 1/10*** | (2006.01) |

(52) U.S. Cl.

CPC ..... *A45C 13/001* (2013.01); *A45C 11/00* (2013.01); *A45F 5/02* (2013.01); *H04R 1/02* (2013.01); *H04R 1/1033* (2013.01); *Y10S 224/93* (2013.01); *H04R 2499/11* (2013.01)

(58) Field of Classification Search

USPC ..... 224/669, 666, 667, 668, 191; 206/320; 81/3.07, 3.09

See application file for complete search history.

(56) References Cited

U.S. PATENT DOCUMENTS

| | | | |
|---|---|---|---|
| 2,630,212 A | 3/1953 | Mosch | |
| 2,993,586 A | 7/1961 | Mosch | |
| 4,474,087 A | 10/1984 | Widman | |

(Continued)

FOREIGN PATENT DOCUMENTS

| | | | |
|---|---|---|---|
| DE | 10014423 | 4/2001 | |
| EP | 1030497 A2 * | 2/2000 | ..... H04M 1/02 |

(Continued)

OTHER PUBLICATIONS

Monaco, et al., International Search Report received from the Patent Office for PCT/US2011/030374, 11 pages, May 27, 2011.*

(Continued)

*Primary Examiner* — Justin Larson
*Assistant Examiner* — Lester L Vanterpool
(74) *Attorney, Agent, or Firm* — Brian S. Steinberger; Law Offices of Brian S. Steinberger, P.A.

(57) ABSTRACT

Holders and cases for supporting portable handheld electronic devices, such as but not limited to iPhones®, IPODS®, IPADS™, cellular phones, smart phones and the like. The holders and cases protect a portable handheld electronics device holder with a built on bottle opener fixed to a rear face of the holders and cases.

20 Claims, 18 Drawing Sheets

(56) References Cited

U.S. PATENT DOCUMENTS

| | | | | |
|---|---|---|---|---|
| 4,478,330 | A | 10/1984 | Lin | |
| 4,569,653 | A | 2/1986 | Becker | |
| 4,846,024 | A | 7/1989 | Bryant | |
| 4,911,038 | A | 3/1990 | Ferrin | |
| 4,923,392 | A | 5/1990 | Moynihan | |
| 5,531,365 | A | 7/1996 | Donnelly | |
| 5,906,031 | A | 5/1999 | Jensen | |
| 6,289,542 | B1 | 9/2001 | Dignam | |
| 6,456,487 | B1 | 9/2002 | Hetterick | |
| 6,471,056 | B1 | 10/2002 | Tzeng | |
| 6,646,864 | B2 | 11/2003 | Richardson | |
| 6,752,299 | B2 | 6/2004 | Shetler | |
| 6,786,372 | B2 | 9/2004 | Enkerlin | |
| 7,230,823 | B2 | 6/2007 | Richardson | |
| 7,240,589 | B2 | 7/2007 | Kehoe | |
| D557,089 | S | 12/2007 | Menard | |
| D564,220 | S | 3/2008 | Dixon | |
| D565,291 | S | 4/2008 | Brandenburg | |
| D575,056 | S * | 8/2008 | Tan | D3/218 |
| 7,409,237 | B2 | 8/2008 | Tages | |
| 7,494,239 | B2 | 2/2009 | Riccardi | |
| 7,513,472 | B2 | 4/2009 | Yang | |
| 7,612,997 | B1 * | 11/2009 | Diebel et al. | 361/679.56 |
| 7,648,027 | B2 | 1/2010 | Lin | |
| 7,673,357 | B1 | 3/2010 | Stump | |
| 7,722,388 | B1 | 5/2010 | Michaeli | |
| D619,573 | S | 7/2010 | Khan | |
| D621,822 | S * | 8/2010 | Richardson et al. | D14/250 |
| 7,778,023 | B1 | 8/2010 | Mohoney | |
| D623,179 | S | 9/2010 | Richardson | |
| D624,909 | S * | 10/2010 | Huskinson | D14/250 |
| D624,910 | S * | 10/2010 | Richardson et al. | D14/250 |
| D637,590 | S | 5/2011 | Michie | |
| D638,413 | S | 5/2011 | Magness | |
| D645,031 | S | 9/2011 | Richardson | |
| 8,016,107 | B2 | 9/2011 | Emsky | |
| D646,265 | S | 10/2011 | Fathollahi | |
| D651,205 | S | 12/2011 | Soekoro | |
| D662,378 | S | 6/2012 | Corredor Londono | |
| D662,380 | S | 6/2012 | Corredor Londono | |
| D666,070 | S | 8/2012 | Shaashua | |
| 8,251,210 | B2 | 8/2012 | Schmidt | |
| D666,885 | S | 9/2012 | Shaashua | |
| 8,333,310 | B2 | 12/2012 | Tages | |
| D674,380 | S | 1/2013 | Soekoro | |
| 8,367,235 | B2 * | 2/2013 | Huang | 429/96 |
| 8,483,786 | B2 * | 7/2013 | Ramies et al. | 455/575.8 |
| 8,579,172 | B2 * | 11/2013 | Monaco et al. | 224/666 |
| D696,239 | S * | 12/2013 | Murchison et al. | D14/250 |
| 2002/0048363 | A1 | 4/2002 | Scheller | |
| 2003/0139169 | A1 | 7/2003 | Arreazola | |
| 2004/0204165 | A1 | 10/2004 | Huang | |
| 2005/0255898 | A1 | 11/2005 | Huang | |
| 2006/0058081 | A1 | 3/2006 | Reichenbach | |
| 2006/0146483 | A1 | 7/2006 | Patino | |
| 2008/0009329 | A1 | 1/2008 | Adler | |
| 2008/0156836 | A1 | 7/2008 | Wadsworth | |
| 2008/0201862 | A1 | 8/2008 | Menard-Flanagan | |
| 2008/0232089 | A1 | 9/2008 | Riccardi | |
| 2009/0000965 | A1 | 1/2009 | Arbel | |
| 2009/0114556 | A1 * | 5/2009 | Tai et al. | 206/320 |
| 2010/0200456 | A1 | 8/2010 | Parkinson | |
| 2010/0224519 | A1 | 9/2010 | Kao | |
| 2011/0031287 | A1 | 2/2011 | Le Gette | |
| 2011/0036876 | A1 | 2/2011 | Fathollahi | |
| 2011/0136555 | A1 | 6/2011 | Ramies | |
| 2011/0253569 | A1 | 10/2011 | Lord | |
| 2012/0325882 | A1 | 12/2012 | Tages | |

FOREIGN PATENT DOCUMENTS

| | | |
|---|---|---|
| EP | 1030497 | 8/2000 |
| EP | 1484901 | 8/2004 |

OTHER PUBLICATIONS

Monaco, et al., International Search Report received from the Patent Office for PCT/US11/30374, 11 pages, May 27, 2011.

* cited by examiner

600

CASES AND COVERS FOR HANDHELD ELECTRONIC DEVICES

CROSS REFERENCE TO RELATED APPLICATIONS

This invention is a Divisional application of U.S. patent application Ser. No. 13/366,013 filed Feb. 3, 2012, now allowed, which is a Divisional of U.S. patent application Ser. No. 12/748,765 filed Mar. 29, 2010, now U.S. Pat. No. 8,485,404. The entire disclosure of each of the applications listed in this paragraph are incorporated herein by specific reference thereto.

FIELD OF INVENTION

This invention relates to cases, in particular to novel cases, covers, faceplates and backplates for protecting and holding portable handheld electronics, such as but not limited to portable devices for downloading and playing music, such as an IPOD®, portable digital electronic devices for sending and receiving phone calls such as an iPhone®), iPad™, cellular phones, mobile phones, mobile video players, MP3 players (MPEG standard for transmitting music over the world wide web, PDA (personal digital assistants), and the like, which have retractable earplug/headphone cords, and with other novel features such as bottle openers.

BACKGROUND AND PRIOR ART

Portable handheld electronics such as mobile phones, and the like, are subject to damage from being dropped or hit into. Damage can include the battery cases being accidentally opened, to the electronic device itself having to be replaced. Various sleeve devices have been used over the years, but these devices often cannot be used with all types of handheld electronic devices such as IPods® and iPhones® manufactured by Apple Computer.

Additionally, many portable electronics are used with headphones, such as earphones, and the like. However, the loose headphones with their cords makes these accessories often difficult to store when not being used. Merely wrapping the cord around the portable electronic device is undesirable, as well as unsightly, and can cause these parts to become damaged over time. Thus, the need exists for a way to protect headphones and their cords when not being used with the portable electronics devices.

U.S. Published Patent Applications: 2004/0204165 to Huang and 2005/0255898 to Huang each describe different types of cellular phone cases having some type of a retractable headphone. However, Huang '165 requires the housing be extra wide to allow the headset to be pulled in along one side of the cellular phone. In addition to creating substantially extra space that can defeat the purpose of having a small cellular phone, this patent requires the cord rewinder to be located at the bottom of the case, which can cause the cord to become tangled and stuck when retracting along the inner side of the case. Additionally, the outer end of the headpiece still remains outside of the case and is not fully protected when retracted, with the exposed end being a snag type hazard. Also, the hanging appearance the of head piece does not create an aesthetic appearance.

Huang '898 does not fix these problems and in fact has the head piece itself remains substantially outside the case when retracted where it can become damaged from its exposure since it is unprotected as well as being a snag hazard. Furthermore, Huang '898 requires a part of the cord to have to hang below the case, and requires the plug to be separately plugged in, which also increases potential damage to the stored phone as well as create another snag hazard. Additionally, the hanging appearance of the head piece and lower hanging cord do not create an aesthetic appearance. Thus, both Huang references teach and describe undesirable types of cases with retractable cords.

Still furthermore, most cases and covers for portable electronic devices such as for cellular type phones are limited to only protecting the electronic device itself. Often the user would need to separately carry beverage accessory devices such as but not limited to bottle cap openers when traveling. Placing a separate bottle cap opener in one's pocket is undesirable, and can easily be forgotten. Also, small devices such as bottle cap openers can be easily lost.

U.S. Pat. No. 7,494,239 to Riccardi issued February 2009 shows a "bottle opener" that can attach to the back of cell phones, where the bottle opener is angled out and can also be used as a belt clip. However, this clip substantially sticks outside and away from the case and would take up undesirable space and would not allow the case to be placed in a pocket such as the breast pocket for storage. Additionally, such as clip can easily snag onto the clothing or other items of the user and would not be desirable.

U.S. Published Patent Application 2006/0146483 to Patino describes a "battery door cover bottle opener" that serves as a cover for a battery and an audio output. However, the location of the opener can result in bottles causing damage to any exterior speaker on the electronics device. Also, the low location of the opener on the back of the housing would require the user having to grab the upper antenna end of the case to open the bottle, which can potentially damage both the antenna and the upper delicate electronics part of the electronics device that is being housed therein.

Thus, the need exists for solutions to the above problems with the prior art.

SUMMARY OF THE INVENTION

A primary objective of the present invention is to provide cases, covers, faceplates and backplates for protecting and holding portable handheld electronics, such as portable devices for downloading and playing music, portable digital electronic devices for sending and receiving phone calls, cellular phones, mobile phones, mobile video players, MP3 players (MPEG standard for transmitting music over the world wide web, PDA (personal digital assistants), and the like, which have retractable earplug/headphone cords, with headphones that are stored out of sight when not used.

A secondary objective of the present invention is to provide cases, covers, faceplates and backplates for protecting and holding portable handheld electronics, such as portable devices for downloading and playing music, portable digital electronic devices for sending and receiving phone calls, cellular phones, mobile phones, mobile video players, MP3 players (MPEG standard for transmitting music over the world wide web, PDA (personal digital assistants), and the like, which have retractable earplug/headphone cords, that do not become snag hazards when not used.

A third objective of the present invention is to provide cases, covers, faceplates and backplates for protecting and holding portable handheld electronics, such as portable devices for downloading and playing music, portable digital electronic devices for sending and receiving phone calls, cellular phones, mobile phones, mobile video players, MP3 players (MPEG standard for transmitting music over the world wide web, PDA (personal digital assistants), and the like, with retractable cords and headpieces that are aesthetically clean in appearance when not being used since there are no remaining hanging parts.

A fourth objective of the present invention is to provide cases, covers, faceplates and backplates for protecting and holding portable handheld electronics, such as portable devices for downloading and playing music, portable digital electronic devices for sending and receiving phone calls, cellular phones, mobile phones, mobile video players, MP3 players (MPEG standard for transmitting music over the world wide web, PDA (personal digital assistants), and the like, which have retractable headpieces and cords that safely protect the headpieces and cords from damage when not used.

A fifth objective of the present invention is to provide cases, covers, faceplates and backplates for protecting and holding portable handheld electronics, such as portable devices for downloading and playing music, portable digital electronic devices for sending and receiving phone calls, cellular phones, mobile phones, mobile video players, MP3 players (MPEG standard for transmitting music over the world wide web, PDA (personal digital assistants), and the like, which have retractable headpieces and cords that do not require extra wide or deep storage cases that are substantially larger than the exterior dimensions of the portable electronics.

A sixth objective of the present invention is to provide cases, covers, faceplates and backplates for protecting and holding portable handheld electronics, such as portable devices for downloading and playing music, portable digital electronic devices for sending and receiving phone calls, cellular phones, mobile phones, mobile video players, MP3 players (MPEG standard for transmitting music over the world wide web, PDA (personal digital assistants), and the like, which have retractable headpieces and cords where insertion of the portable electronics allows for direct connection to an interior prong that is connected to the retracted cord and headpiece.

A seventh objective of the present invention is to provide cases, covers, faceplates and backplates for protecting and holding portable handheld electronics, such as portable devices for downloading and playing music, portable digital electronic devices for sending and receiving phone calls, cellular phones, mobile phones, mobile video players, MP3 players (MPEG standard for transmitting music over the world wide web, PDA (personal digital assistants), and the like, having built on accessories such as bottle openers, that do not substantially stick out from the electronics.

An eighth objective of the present invention is to provide cases, covers, faceplates and backplates for protecting and holding portable handheld electronics, such as but not limited to IPods®, iPhones®, iPads (portable handheld notepad computer with video and text messaging and emailing, for wireless transmissions) cellular phones, mobile phones, mobile video players, MP3 players, PDA (personal digital assistants), having built on accessories such as bottle openers, that are not snag hazards.

A ninth objective of the present invention is to provide cases, covers, faceplates and backplates for protecting and holding portable handheld electronics, such as portable devices for downloading and playing music, portable digital electronic devices for sending and receiving phone calls, cellular phones, mobile phones, mobile video players, MP3 players (MPEG standard for transmitting music over the world wide web, PDA (personal digital assistants), and the like, having built on accessories such as bottle openers, that would not potentially damage the portable electronics when the bottle opener is being used.

A preferred embodiment of the holder for handheld electronics can include a backplate having a support frame sleeve sized to fit substantially about perimeter edges of a portable handheld electronic device, a storage compartment having a lid that is attached to an upper surface portion of the backplate, and a cord and headpiece for being used with the portable handheld electronic device, the cord and headpiece being both capable of being stored inside of the compartment beneath under the lid of the compartment when not being used, and the headpiece and the cord being capable of being removed from the compartment when used with the portable handheld electronic device.

The lid can include a hinge edge for allowing the lid to open or close the compartment. The holder can include a cord winder attached to the backplate, the cord winder allowing both the cord and the headpiece to be fully retracted into the compartment under the lid.

The holder can include a plug attached to the cord, the plug located inside of the support frame sleeve so that sliding the portable electronic device into the backplate connects a socket in the portable electronic device to the cord and headset, and sliding the portable electronic device out of the support frame sleeve separates the cord from the socket of the portable electronics device.

The holder can include a bill (money) clip extending downward from the compartment for allowing the holder to be clipped onto a belt or pocket of a user.

The clip can include a depressible switch for allowing the clip to be detached from the compartment.

The holder can support and protect a portable electronics device being an iPhone®. The holder can support and protect a portable electronics device being an IPOD®, iPad™ (portable handheld notepad computer with video and text messaging and emailing, for wireless transmissions). The holder can support and protect a portable electronics device being a portable phone.

An accessory holder embodiment for handheld electronics, can include a backplate having a support frame sleeve sized to fit substantially about perimeter edges of a portable handheld electronic device, a slightly raised box attached to an upper surface portion of the backplate the box having a substantially planar outer face that is substantially parallel to a longitudinal axis of the backplate, and a bottle opener fixed in the planar outer face.

An embodiment of this invention is the ability to use specific components (components labeled 280, 270, and 300) of the case as a separate entity to act as a headphone or earpiece holder with the features of an enclosable case and the self-winding feature that retracts the cords associated with the headphone or earpiece.

The raised box has side edges which slope out from the backplate. The portable handheld electronic device can be an iPhone®. The portable handheld electronic device can be an IPOD®. The portable handheld electronic device can be a iPad™. The portable handheld electronic device can be a portable phone.

Further objects and advantages of this invention will be apparent from the following detailed description of the presently preferred embodiments which are illustrated schematically in the accompanying drawings.

DESCRIPTION OF THE PREFERRED EMBODIMENTS

Figure 2:
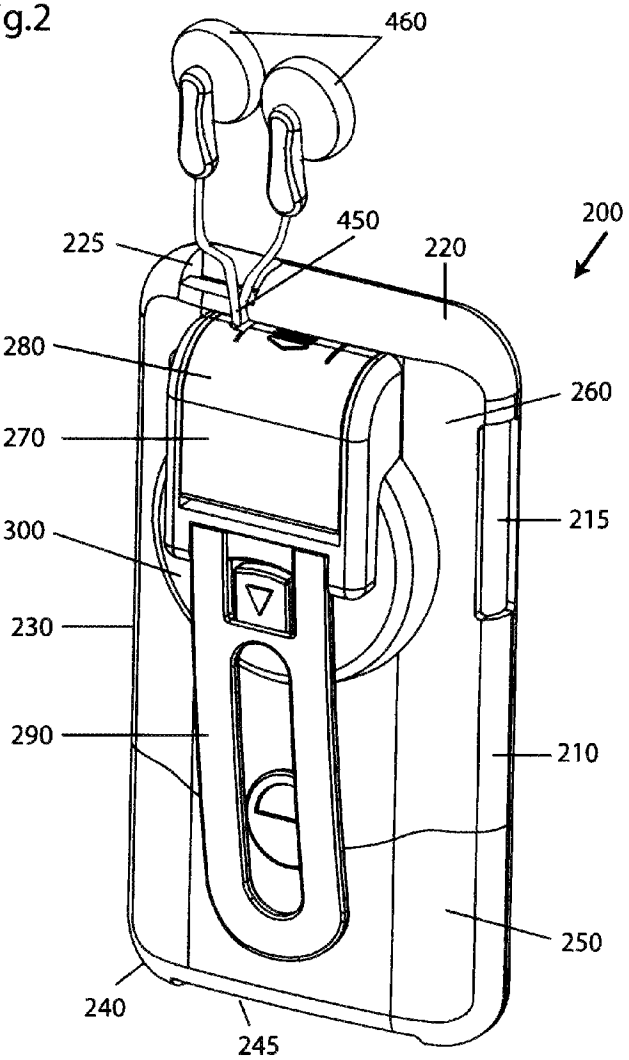
FIG. 2 is a perspective view of a backing plate for the holder of the invention attached to the front plate of FIG. 1.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

The inventions can be used with holding portable handheld electronics, such as portable devices for downloading and playing music (such an IPOD®), portable digital electronic devices for sending and receiving phone calls (such as an iPhone®), iPad™ (portable handheld notepad computer with video and text messaging and emailing, for wireless transmissions), cellular phones, mobile phones, mobile video players, MP3 players (MPEG standard for transmitting music over the world wide web, PDA (personal digital assistants), and the like. A list of components will now be described.

1. Holder of combined front plate and backing plate
100 Front plate
110 left side edge
115 upper slot
120 top side edge
125 hole for the on/off button
130 right side edge
140 bottom side edge
145 slot in bottom edge
190 downwardly protruding inside prong
195 male tip
200 Backing plate
210 right side edge
215 upper slot
220 top side edge
225 hole for the on/off button
230 left side edge
240 bottom edge
245 slot in bottom edge
250 lower half of backing plate
252 upwardly facing tab
254 raised protrusion
260 upper half of backing plate
262 downwardly facing tab
264 slot in tab
270/280 upper rear compartment and hinged door on backing plate
275 hinge prong slots for button clip hinge prongs 295
282 hinge side extending prongs
285 locking pins on top of lid
289 raised outer gripping surface
290 downwardly protruding bill clip
292 depressible button
293 protruding portion
294 slot in housing 300 for protruding portion 293

Figure 1:
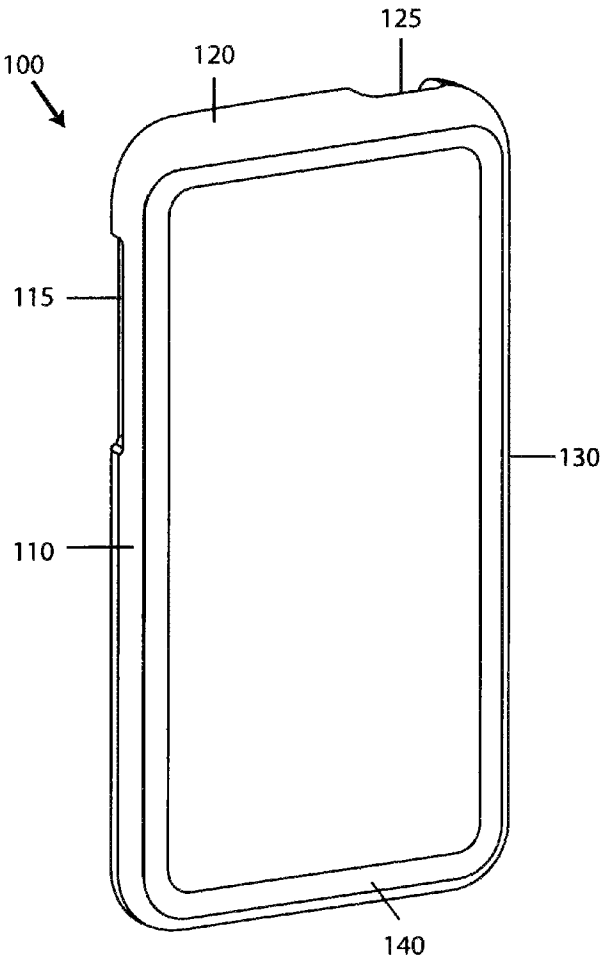
FIG. 1 is a perspective view of a front plate for the holder of the invention.

295 hinge side prongs of button
300 rewinder component housing
310 axle pin
320 rotatable wheel to hold cord
325 opening in wheel
330 metal coil (allows unit to extend out and retract)
340 ball bearing for the wheel to turn to extend and retract back
350 cord cover
360 inner back cover
400 cord
410 end attached to male prong
420 wrapped cord
450 end attached to headpiece
460 headpiece (earphone/headset)
500 portable handheld electronics device
510 female socket on electronics device
600 second embodiment
620 lower rear backing plate
610 upper snapable rear backing plate
790 upwardly protruding inside prong
795 male tip
800 Another portable handheld electronics device
810 female socket on electronics device
900 Holder with bottle cap opener
910 snapable bottom of holder
915 slit in bottom of holder
920 top of holder
930 raised inwardly sloping side walls of partially raised upper box
932 reinforcement ribs
940 opening in face shaped to open bottle caps
950 tab to open bottle caps
1000 portable handheld electronics device FIG. 1 is a perspective view of a front plate 100 for the holder 1 of the invention. The front plate 100 can include a left side edge 110, with upper longitudinal slot 115, top side edge 120 with hole 125 for the on/off button, right side edge 130 and bottom side edge 140.

FIG. 2 is a perspective view of a rear plate 200 with the front plate 100 attached thereto that combines into the holder 1 of the invention.

Figure 4:
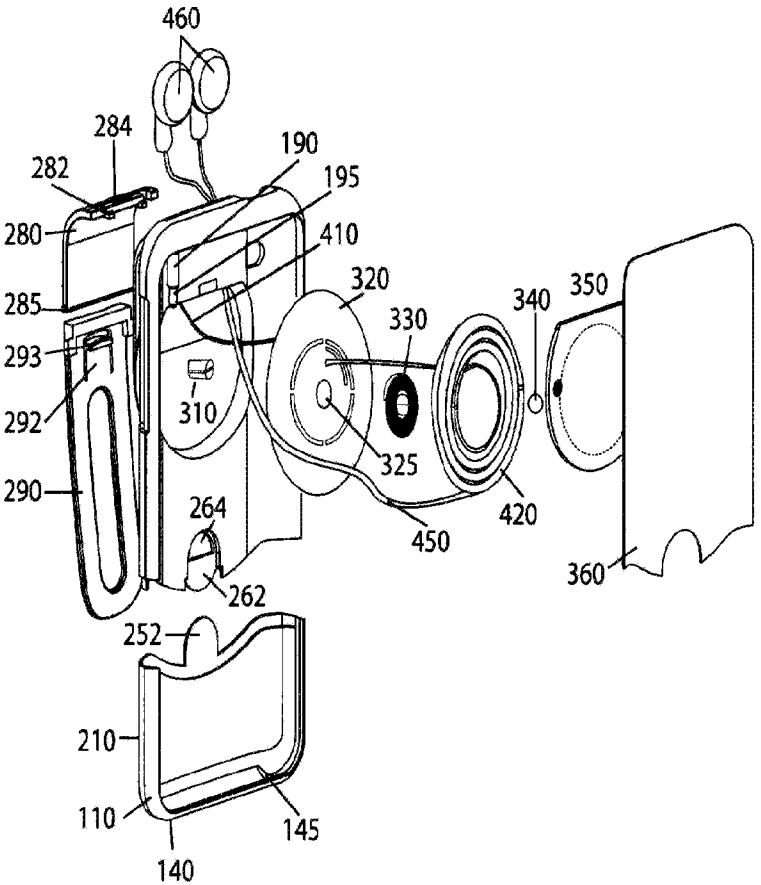
FIG. 4 is an exploded front view of the combined front plate and backing plate of the holder with rewinder, storage compartment lid and clip detached from the holder.
Figure 3:
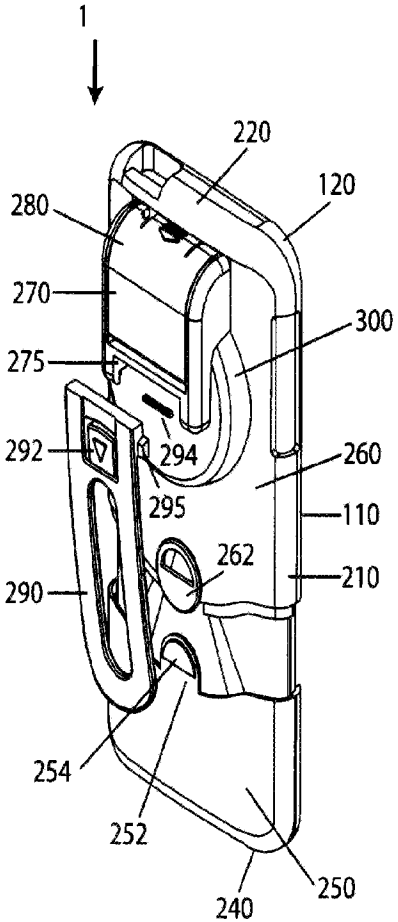
FIG. 3 is another perspective view of the backing plate of FIG. 2 with front plate of FIG. 1 with backing plate separated apart and rear clip detached from the backing plate.

FIG. 3 is another perspective view of the backing plate 200 of FIG. 2 with front plate 100 of FIG. 1 with backing plate 200 separated apart and rear clip 290 detached from backing plate 200. FIG. 4 is an exploded front view of the combined front plate 100 and backing plate 200 of the holder 1 with rewinder components 300-350, storage compartment lid 280 and clip 290 detached from the holder 1.

Figure 6:
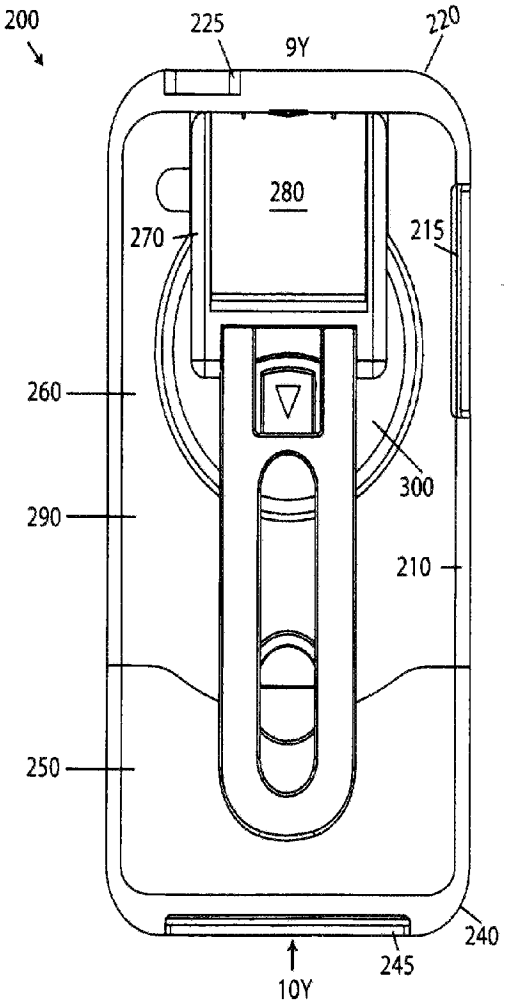
FIG. 6 is a rear view of the combined front plate and backing plate of FIG. 5.
Figure 5:
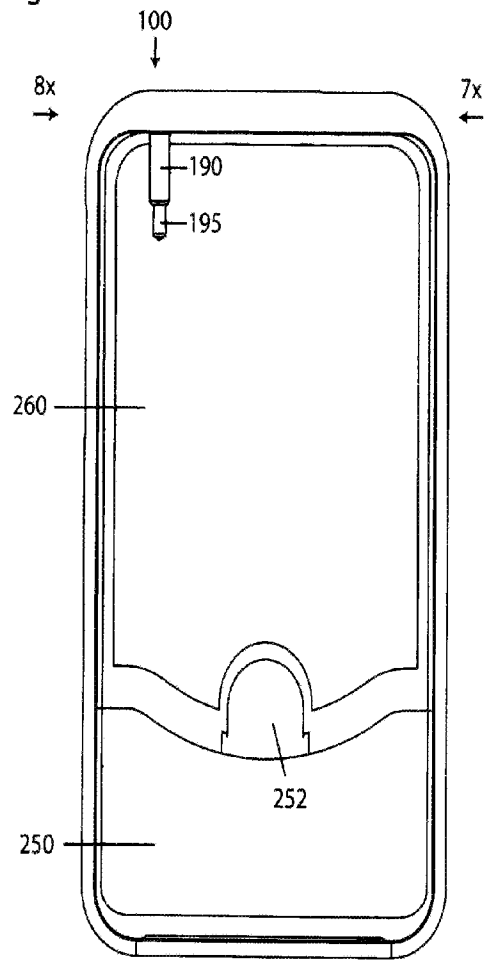
FIG. 5 is a front view of the combined front and backing plates of the holder of FIG. 3.
Figure 8:
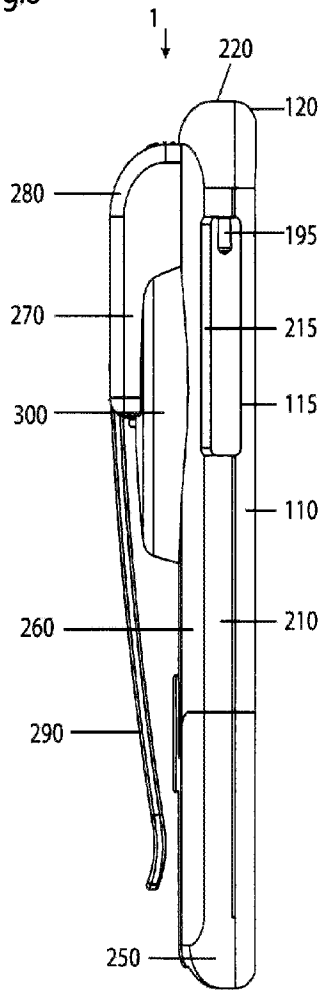
FIG. 8 is a left side view of the combined front and backing plates of FIG. 5 along arrow 8X.
Figure 7:
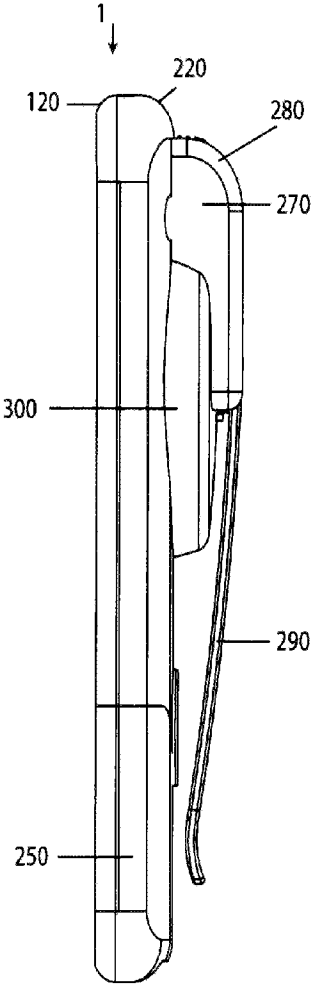
FIG. 7 is a right side view of the combined front and backing plates of FIG. 5 along arrow 7X.
Figure 10:
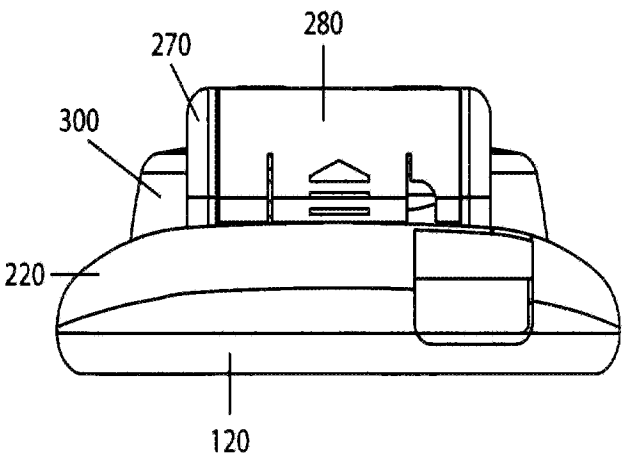
FIG. 10 is a bottom view of the combined front and backing plate of FIG. 6 along arrow 10Y.
Figure 9:
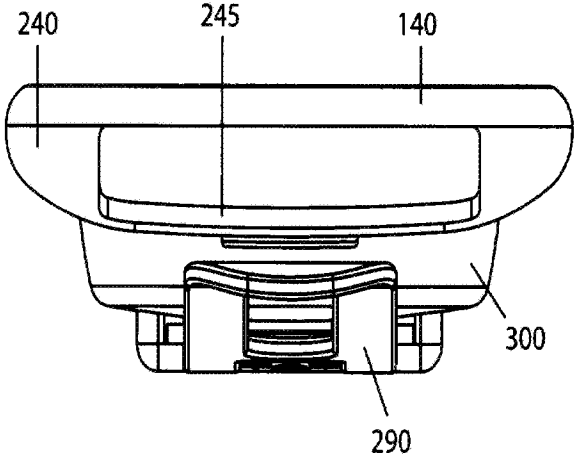
FIG. 9 is a top view of the combined front and backing plate of FIG. 6 along arrow 9Y.

FIG. 5 is a front view of the combined front 100 and backing plates 200 of the holder 1 of FIG. 3. FIG. 6 is a rear view of the combined front plate 100 and backing plate 200 of FIG. 5. FIG. 7 is a right side view of the combined front 100 and backing plates 200 of FIG. 5 along arrow 7X. FIG. 8 is a left side view of the combined front 100 and backing plates 200 of FIG. 5 along arrow 8X. FIG. 9 is a top view of the combined front 100 and backing plate 200 of FIG. 6 along arrow 9Y. FIG. 10 is a bottom view of the combined front 100 and backing plate 200 of FIG. 6 along arrow 10Y.

Referring to FIGS. 1-10, the holder 1 can be use to support portable handheld electronic devices, as described above. The backing plate 200 can be two parts that snap together. The backing plate 200 can include a lower half 250 with an upwardly facing tab 252 with raised protrusion 254 that can interlock with a slot 264 in downwardly facing tab 262 of the upper half 260 of the backing plate 200.

On the upper portion of the backing plate 200 can be a rear compartment 270 molded about a rewinder component housing 300. The one piece compartment lid 270/280 can have hinged side prongs 285 at a lower side and with a pair of locking pins that mateably attach to like holes to close the compartment 270. A raised outer gripping surface 289 allows a user's finger to open and close the lid 280 to the compartment 270.

Attached to the compartment 270 can be a removable bill (money) or belt type clip 290 that can be use do clip the holder 1 to belts, or pockets of the user. The bill type clip 290 can include a depressible button 292 with hinge side prongs 295 that fit into inner side edge slots 275 on the lower part of the container 270. The other side of the button 292 has a protruding portion 293 that can fit into a slot 294 on the outside of the rewinder housing 300, wherein depressing the button 292 toward the holder 1 can allow the clip 290 to drop from and be separated from the holder 1.

A rewinder component housing 300 can be attached to an upper portion of the backing plate 200 beneath the lid 280 of the compartment. The rewinder housing 300 can be sized to fit within a lower part of the compartment 280. Inside the rewinder housing 300 which can be generally cylindrical can be an axle pin 310 that supports a rotatable wheel 320 with opening 325 that fits over the axle pin 310. The wheel 320 can have raised surfaces that supports a metal coil 330 and a ball bearing 340 and cover 350 and inner wall cover 360 that supports a wound cord 420 thereon. Such rewinder components can be similar to those found in U.S. Patent Application Publication 2004/0204165 to Huang, which is incorporated by reference. The user can pull on the exposed cord 450 which activate the spring loaded rewinder which can retract the entire cord end 450 and entire headpiece 460 into the compartment 270.

The wound cord 420 can have an end 450 attached to a headpiece 460, such as but not limited to an earphone, two earphones, a small headset, headphones with small microphone (so user can answer calls) and the like. Additionally, the headphones can be wireless headphones that can be stored inside the compartment. The opposite end 410 of the wound cord 420 can be attached to an inwardly protruding prong 190 on the under side of front plate 100 with a male tip 195, the significance which will be described later.

Figure 11:
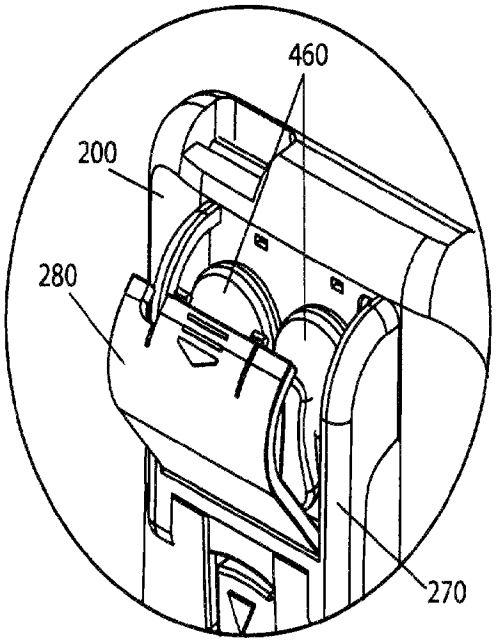
FIG. 11 is an upper enlarged view of the storage compartment on the back plate of the holder of FIGS. 1 and 6 with the compartment lid in an open position with both the headpiece and cords stored inside the compartment.

FIG. 11 is an upper enlarged view of the storage compartment 270 on the back plate 200 of the holder of FIGS. 1 and 6 with the compartment lid 280 in an open position with both the headpiece 460 and cords (underneath headpiece) stored inside the compartment 270. As shown, the lid 280 can easily close the compartment 270 and store the entire headpiece 460 and cords inside when the headpiece is not being used.

Figure 12:
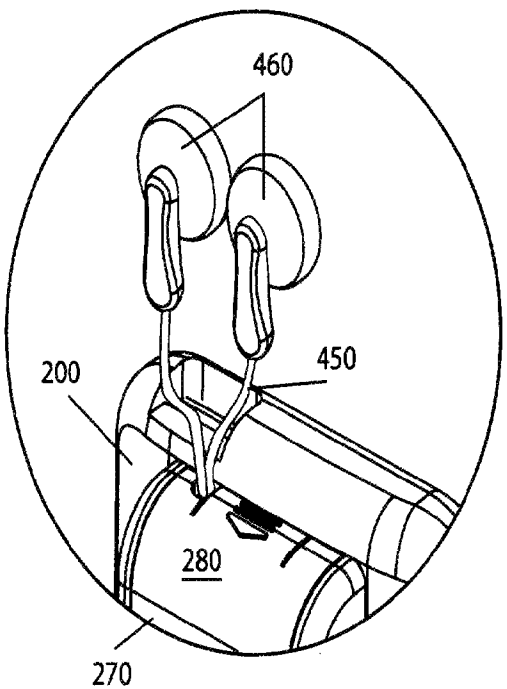
FIG. 12 is another enlarged view of the storage compartment of FIG. 11 with the lid closed and the headpiece pulled outside of the compartment when being used.

FIG. 12 is another enlarged view of the storage compartment 270 of FIG. 11 with the lid 280 closed and the headpiece 460 pulled outside of the compartment 270 when being used. Here, the lid 280 can be in a closed position, and the headpiece pulled to an extended position to be used by the user.

Figure 13:
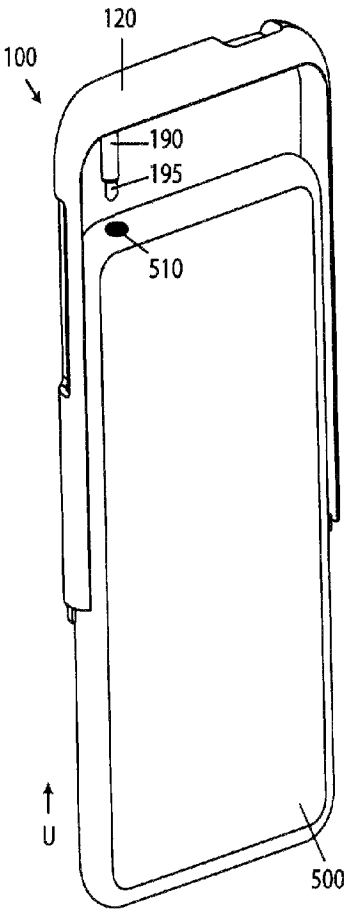
FIG. 13 shows the holder front frame separated from the backplate with the inwardly protruding cord attached male prong about to be inserted into a female socket of a portable handheld electronics device.

FIG. 13 shows the holder front plate separated from the backplate with the inwardly protruding cord attached male prong 190, 195 about to be inserted into a female socket 510 of a portable handheld electronics device 500.

Figure 14:
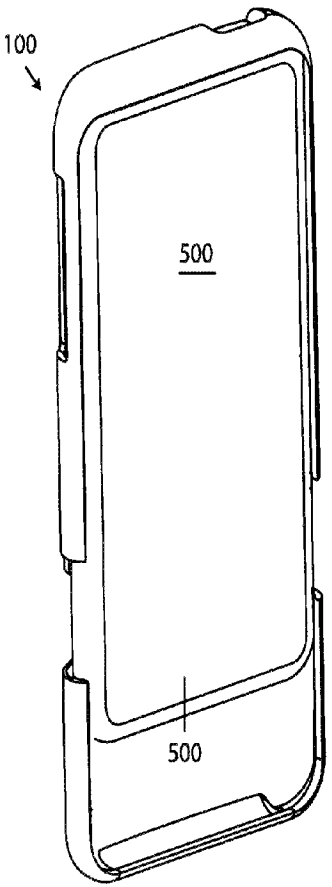
FIG. 14 is another view of the portable handheld electronics device of FIG. 13 slid into the upper part of the holder front frame with the male prong now inserted into the female socket on the top of the portable handheld electronics device.

FIG. 14 is another view of the portable handheld electronics device 500 of FIG. 13 slid into the upper part of the holder front plate 100 with the male prong 190, 195 now inserted into the female socket 510 on the top of the portable handheld electronics device 500. Referring to FIGS. 4, 8, 13 and 14, a portable handheld electronics device 500, such as an iPhone®, and the like, can be slid upward in the direction of arrow U so that the upper female socket 510 can wrap about the downwardly projecting male prongs 190, 195 that are mounted in the inner top of the front plate 100 of the holder. Moving in the opposite direction, the portable handheld electronics device 500 can be separated and detached from the holder 1.

Figure 16:
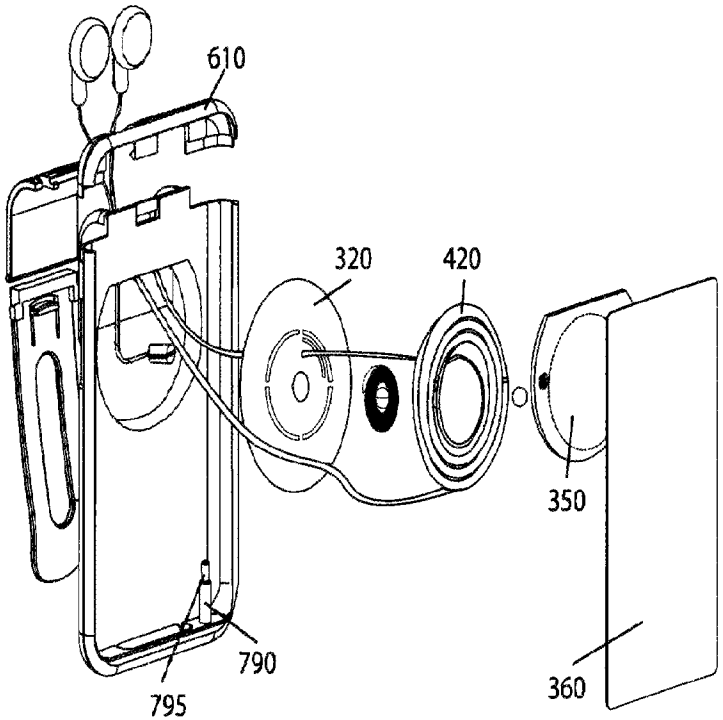
FIG. 16 is an exploded front view of the backing plate of the holder of FIG. 15 with rewinder, storage compartment lid and clip detached from the holder.
Figure 15:
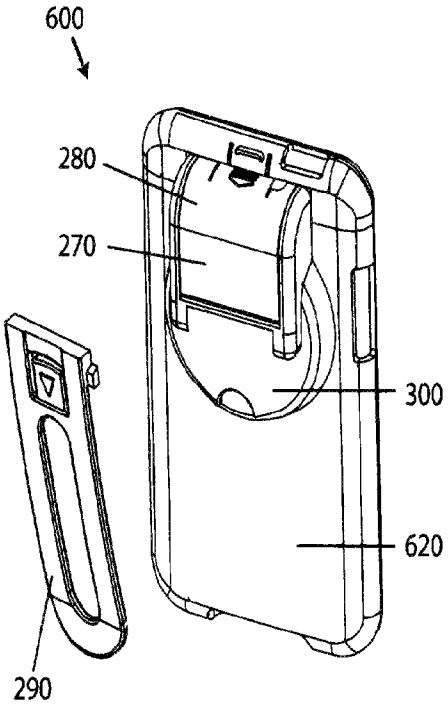
FIG. 15 is a perspective view of another embodiment of the holder showing a backing plate with rear clip detached from the backing plate.
Figure 18:
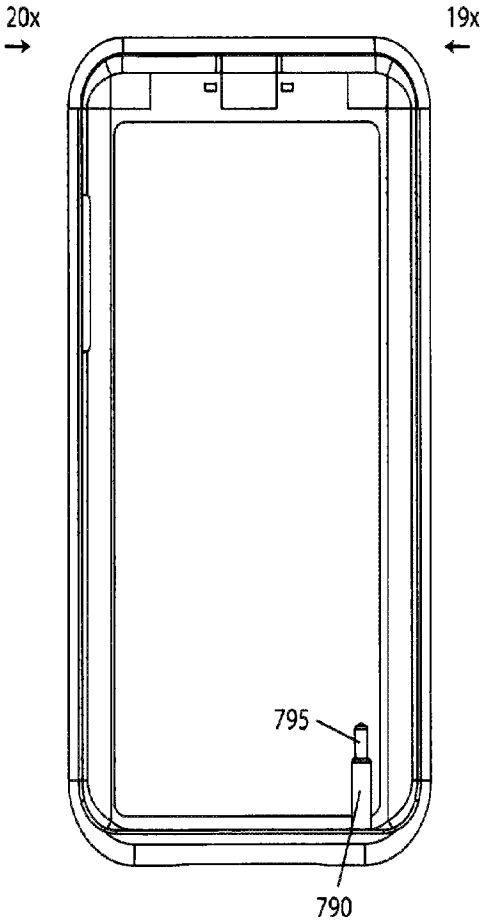
FIG. 18 is a front view of the holder of FIG. 17.
Figure 17:
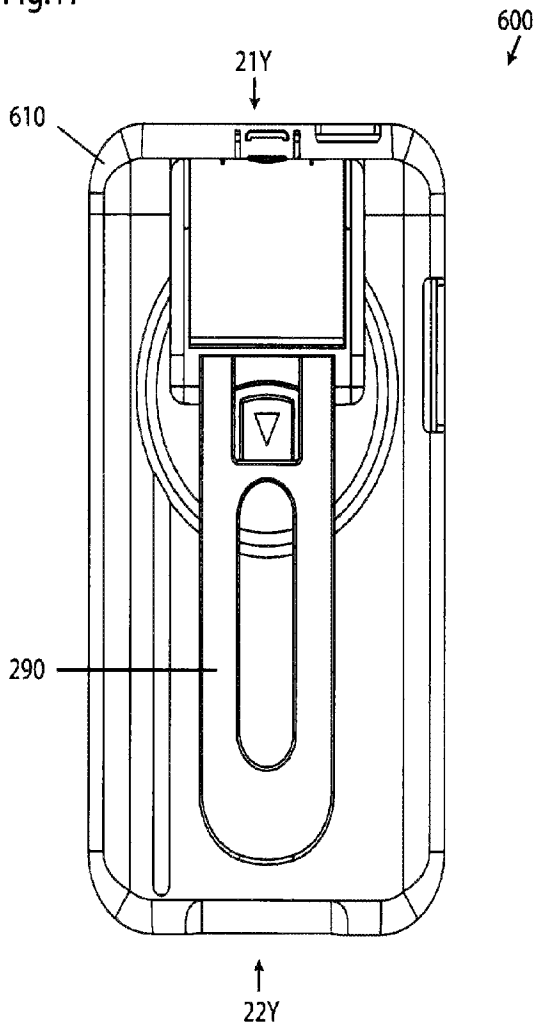
FIG. 17 is a rear view of the holder of FIG. 16.
Figure 20:
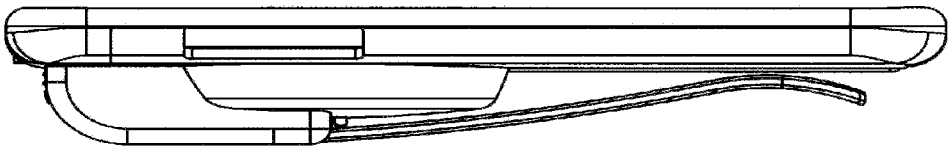
FIG. 20 is a left side view of the holder of FIG. 18.
Figure 19:
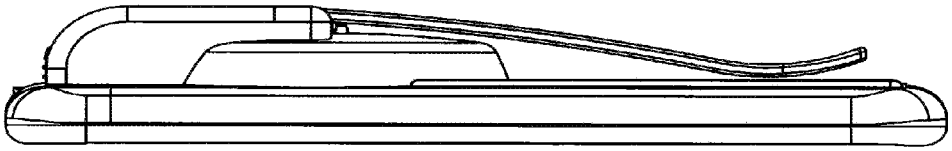
FIG. 19 is a right side view of the holder of FIG. 18.
Figure 22:
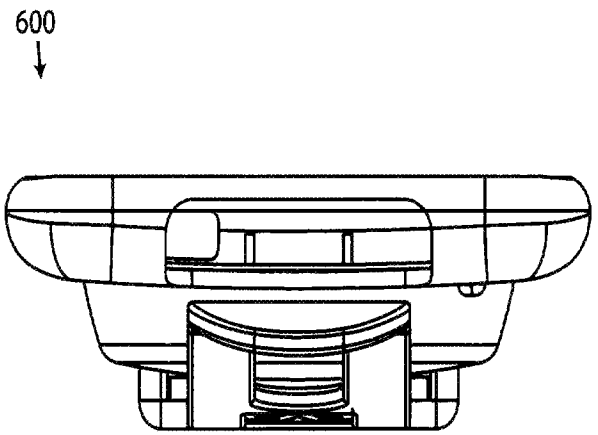
FIG. 22 is a bottom side view of the holder of FIG. 17.
Figure 21:
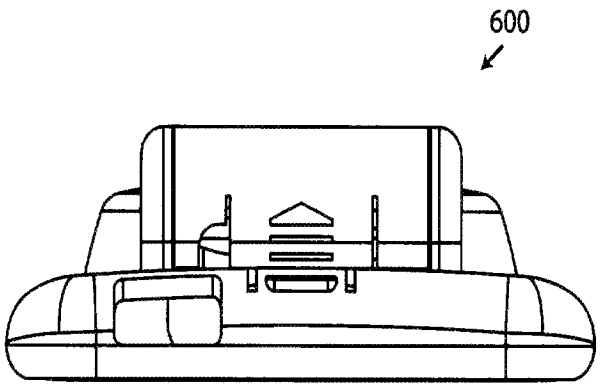
FIG. 21 is a top side view of the holder of FIG. 17.
Figure 24:
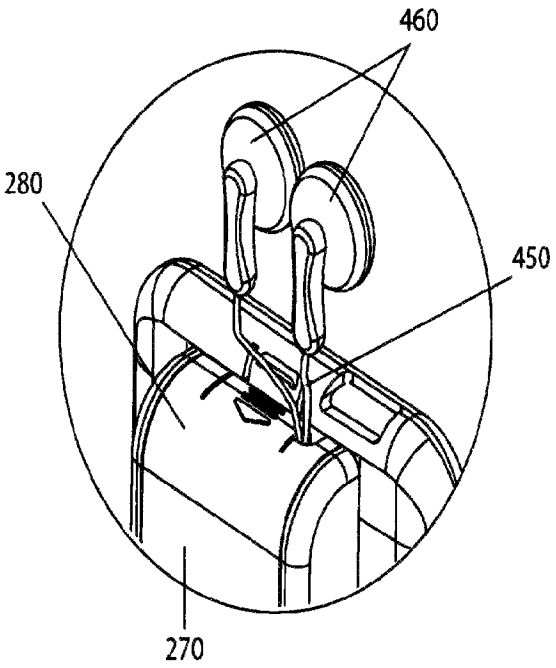
FIG. 24 is another enlarged view of the compartment of FIG. 23 with the lid closed and only the headpiece with cord end extending out from the compartment.
Figure 23:
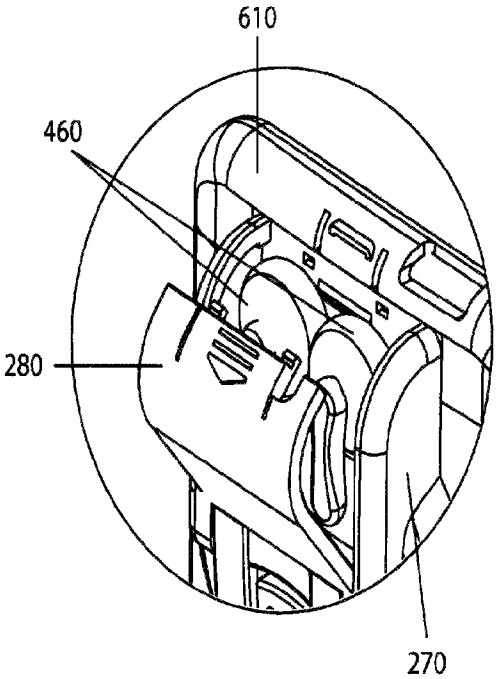
FIG. 23 is an upper enlarged view of the compartment in an open position with cord and headpiece fully inserted inside.

FIG. 15 is a perspective view of another embodiment of the holder 600 showing a backing plate 610, 620 with rear clip 290 detached from the backing plate 610, 620. FIG. 16 is an exploded front view of the backing plate 610, 620 of the holder 600 of FIG. 15 with rewinder components 300-360, storage compartment lid 280 and clip 290 detached from the holder 600. FIG. 17 is a rear view of the holder 600 of FIG. 16. FIG. 18 is a front view of the holder 600 of FIG. 17. FIG. 19 is a right side view of the holder 600 of FIG. 18. FIG. 20 is a left side view of the holder 600 of FIG. 18. FIG. 21 is a top side view of the holder 600 of FIG. 17. FIG. 22 is a bottom side view of the holder 600 of FIG. 17. FIG. 23 is an upper enlarged view of the compartment 270 in an open position with cord and headpiece 460 fully inserted inside. FIG. 24 is another enlarged view of the compartment of FIG. 23 with the lid 280 closed and only the headpiece 460 with cord end 450 extending out from the compartment.

Referring to FIGS. 15-24, the second embodiment can be used with other types of portable handheld electronics devices, such as but not limited to iPhones®, iPads®, and the like. This holder 600 can have similar components to that of the previous embodiment 1 with the exception that the holder 600 can be single backing plate 600 with perimeter side edges which can wrap about a portable handheld electronics device. The backing plate can have an upper snapable rear backing plate 610 that can snap about and attach to a lower backing plate. The other components can be similar to those described and shown in the embodiment of preceding FIGS. 1-14.

Another difference here is the inner prong is an upwardly protruding prong 790 with male tip 795 that is on the inner surface of the bottom of the holder 600.

Figure 26:
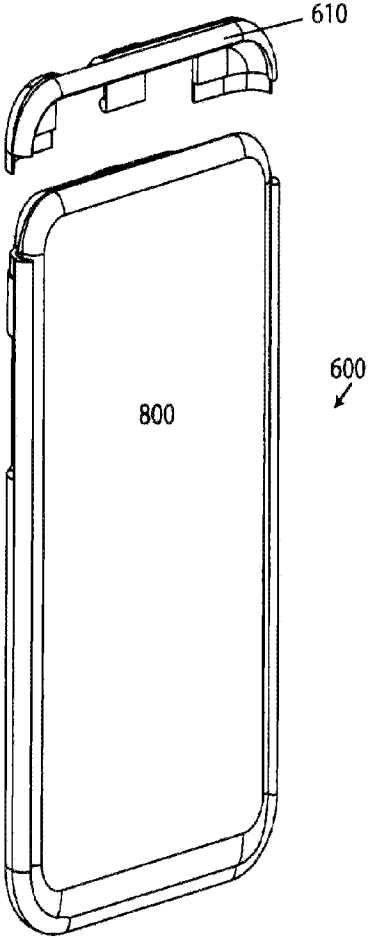
FIG. 26 shows the portable handheld electronics device slid into place in the front plate of the holder so that the male prong for the headpiece is connected to the electronics device.
Figure 25:
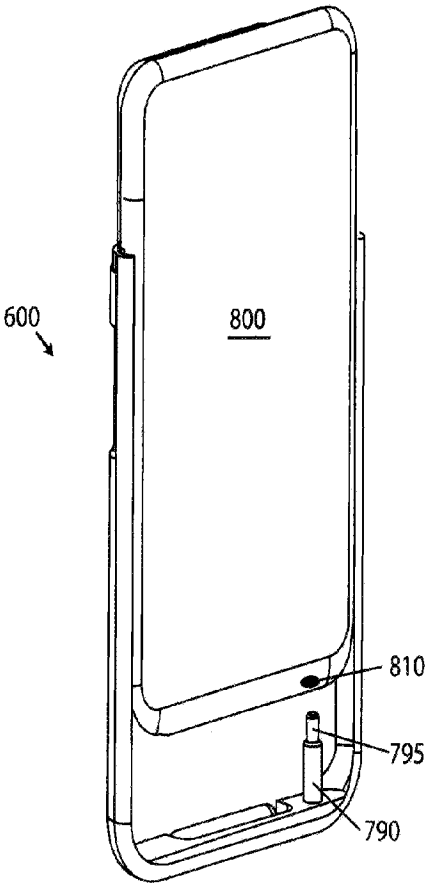
FIG. 25 shows the holder frame where the portable electronics device is about to be slid into the holder so that the female socket on the portable handheld electronics device can wrap about the upwardly protruding male prong on the front plate.

FIG. 25 shows the holder frame where the portable electronics device 800 is about to be slid into the holder 600 so that the female socket 810 on the portable handheld electronics device 800 can wrap about the upwardly protruding male prong 790, 795 on the bottom of the holder 600. FIG. 26 shows the portable handheld electronics device 800 slid into place into the holder 600 so that the male prong 790, 795 for the headpiece 460 is connected to the electronics device 800. The upper snapable backing plate part 610 can then lock the portable handheld electronics device 800 into the protective holder.

Figure 28:
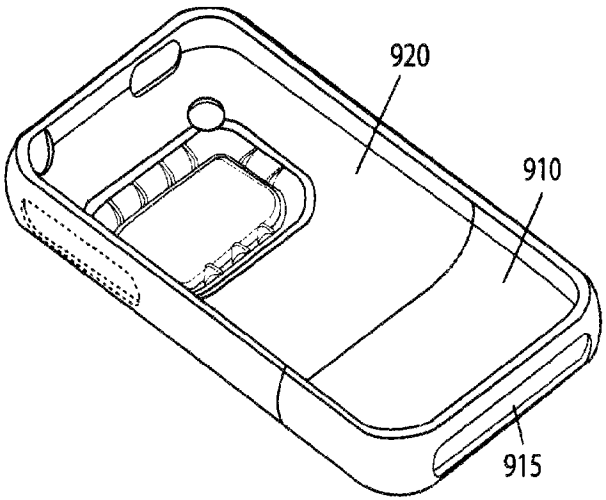
FIG. 28 is an interior perspective view of the backing holder of FIG. 27.
Figure 27:
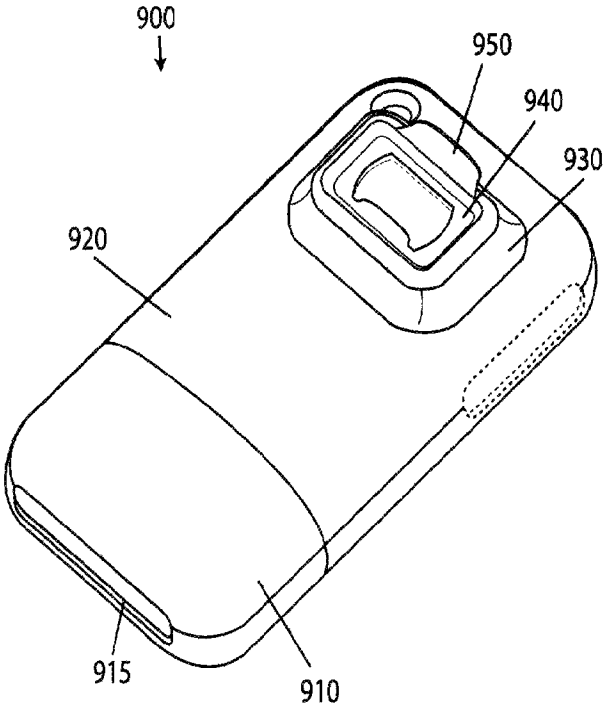
FIG. 27 is another embodiment showing a perspective view of a backing holder for a portable handheld electronics device with a built in bottle opener.
Figure 30:
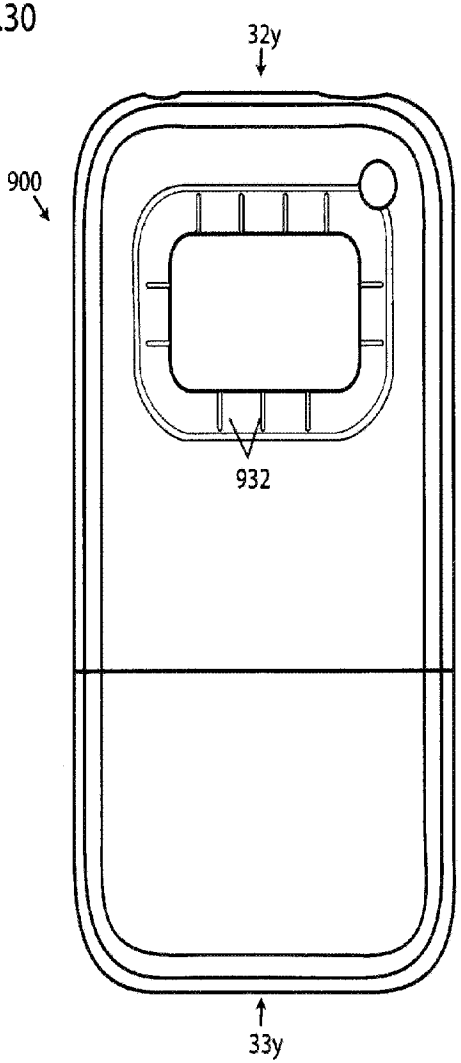
FIG. 30 is a planar view of the inside of the backing holder of FIG. 28.
Figure 29:
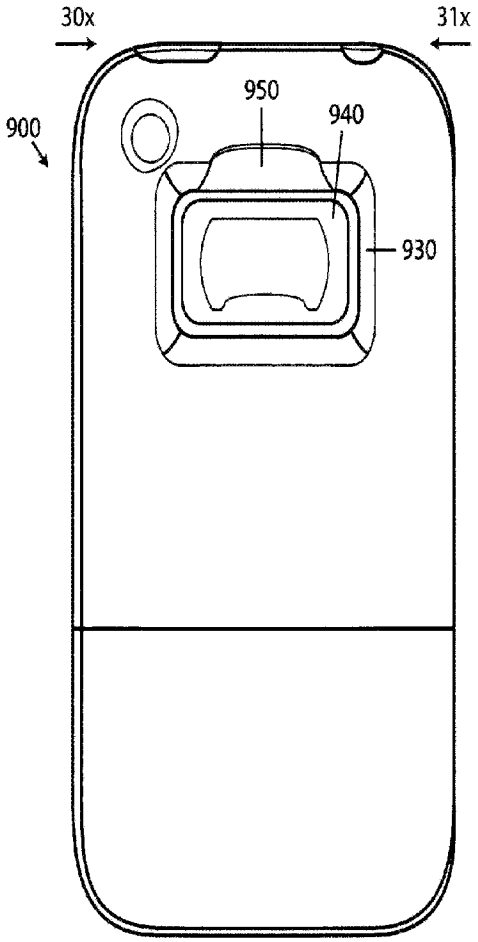
FIG. 29 is a planar view of the backing holder of FIG. 27.
Figure 32:
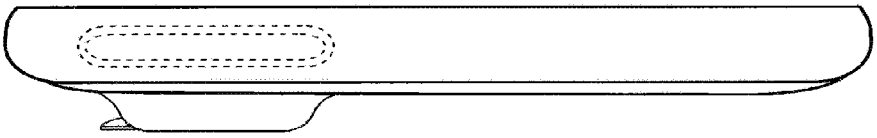
FIG. 32 is a left side view of the holder of FIG. 29 along arrow 32X.
Figure 31:
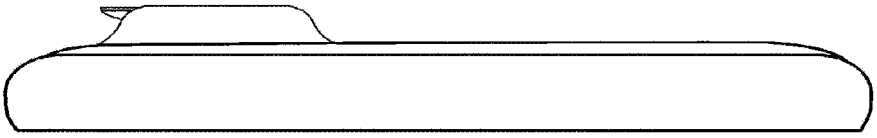
FIG. 31 is a right side view of the holder of FIG. 29 along arrow 31X.
Figure 33:
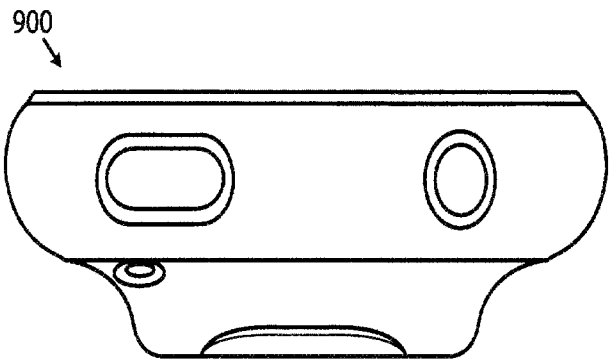
FIG. 33 is a top side view of the holder of FIG. 30 along arrow 32Y.
Figure 36:
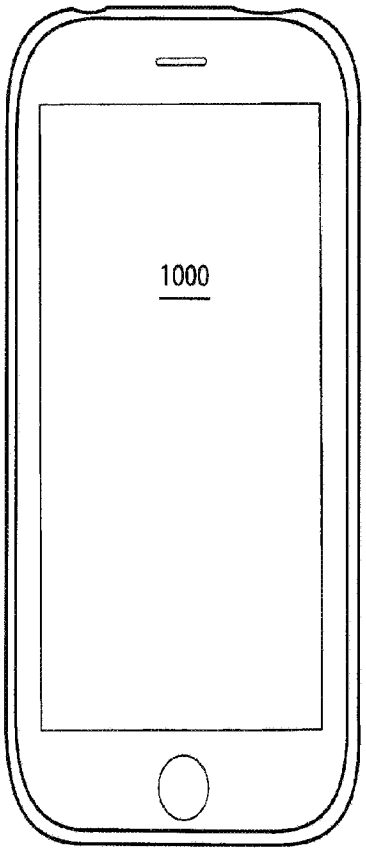
FIG. 36 shows the holder attached to the portable handheld electronics device of FIG. 35.

FIG. 27 is another embodiment showing a perspective view of a backing holder 900 for a portable handheld electronics device (shown as 1000 in FIGS. 34-35) with a built in bottle cap opener 930, 940, 950. FIG. 28 is an interior perspective view of the backing holder 900 of FIG. 27. FIG. 29 is a planar view of the backing holder 900 of FIG. 27. FIG. 30 is a planar view of the inside of the backing holder 900 of FIG. 28. FIG. 31 is a right side view of the holder 900 of FIG. 29 along arrow 31X. FIG. 32 is a left side view of the holder 900 of FIG. 29 along arrow 32X. FIG. 32 is a top side view of the holder 900 of FIG. 30 along arrow 32Y. FIG. 33 is a bottom side view of the holder 900 of FIG. 30 along arrow 33Y.

Referring to FIGS. 27-33, the holder 900 can be in two parts 910, 920 that snap together with side edges that wrap about perimeter edges of a portable handheld electronics device such as but not limited to a mobile phone, and the like. A bottom slit 915 in the bottom of the holder 900 allows for an easier fit about the portable handheld electronics device. The upper part of the holder can include a slightly raised box portion having inwardly sloping side walls 930 that form a planar type face with an opening 940 formed from metal, hardened plastic, and the like, that can be sized to open bottle caps on sodas, beer bottles, and the like. An additional raised tab 950 can also be used to open soda, beer, drink cans as well when needed. The inwardly sloped walls 930 can have reinforcement ribs 932 to better support the bottle cap opener face 940.

Figure 34:
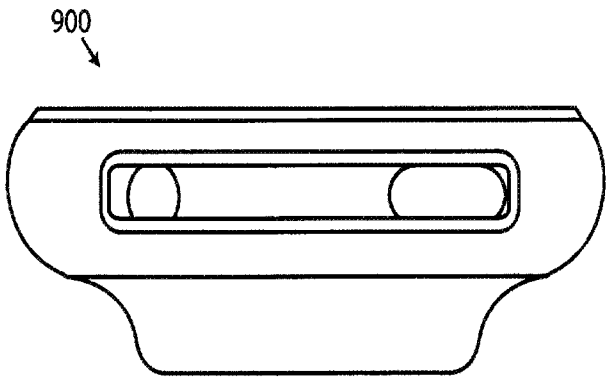
FIG. 34 is a bottom side view of the holder of FIG. 30 along arrow 33Y.
Figure 35:
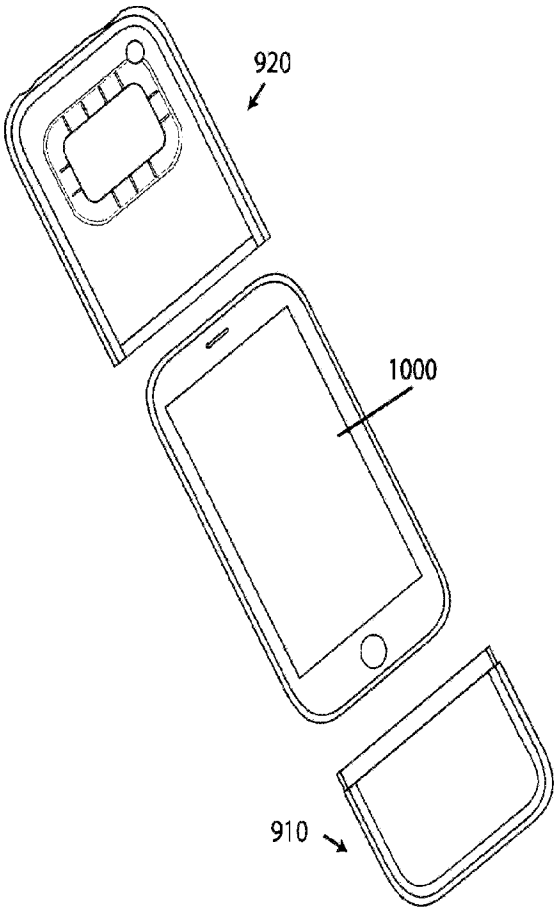
FIG. 35 is an exploded view of the holder about to slid about a portable handheld electronics device.

FIG. 34 is an exploded view of the upper and lower parts 910, 920 of the holder 900 about to slid about a portable handheld electronics device 100. FIG. 35 shows the holder 900 where the parts 910, 920 are snapped together to be attached to the portable handheld electronics device of FIG. 34.

An embodiment of this invention is the ability to use specific components (components labeled 280, 270, and 300) of the case as a separate entity to act as a headphone or earpiece holder with the features of an enclosable case and the self-winding feature that retracts the cords associated with the headphone or earpiece.

Although the invention describes the embodiments of a storage compartment on the holder separate from the bottle opener embodiment, the invention can be practiced where the storage compartment and bottle opener accessory are on the same backing plate, with one on top of the other.

While the invention has been described as storing retractable cords with headpieces, the invention can be used for just storing headpieces, such as wireless headphones, when needed, or just storing headphones without the use of the retractable cord features. Also, the invention can be used to fully store and protect earphones and headphones having separate pluggable cords.

As previously discussed, the headpiece can be a single earphone, two earphones or a small headset. The holders described and shown can be made from materials such as but not limited to injection molded plastic, composites, rubber type materials, metal, combinations thereof, and the like. Additionally, the holders can be made of other materials, such as but not limited to leather, cloth, linen, and other natural materials.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A portable case for a portable handheld electronics device, comprising:

a cover having a separate top section and separate bottom section which attach and detach from one another, the cover having a front face and a rear face, the front face having a top wall and a bottom wall and a left side wall and a right side wall, the cover being sized and shaped for engaging and at least partially encasing a portable handheld electronics device, the portable handheld electronics device having a rear exterior face and a front exterior face and four sides with perimeter edges about the four sides, the cover for protecting the rear exterior face and the four sides and the perimeter edges of the portable handheld electronics device, the front face of the portable handheld electronics device being left open to be operable with the cover; and a bottle opener positioned within and permanently attached to the rear face of the separate top section of the cover, such that the bottle opener is always exposed to be used from the rear face of the cover wherein the portable case is a separate component from the rear exterior wall of the portable handheld electronics device.

2. The portable case of claim 1, wherein the cover is made from plastic.

3. The portable case of claim 1, wherein the bottle opener partially protrudes beyond a planar surface of the rear face of the cover.

4. The portable case of claim 1, wherein the bottle opener includes:

a tab adapted for additionally opening a can tab on a beverage can.

5. The portable case of claim 1, further comprising:

sloping walls adjacent to the bottle opener.

6. The portable case of claim 5, wherein the sloping walls include:

thickened portions for reinforcing the bottle opener to the case.

7. The portable case of claim 1, further comprising:

a closed wall separating the bottle opener from the rear exterior wall of the portable handheld electronics device.

8. The portable case of claim 1, wherein the bottle opener is in a fixed position on the rear face of the case, and is operable to remove caps from bottles in the fixed position on the rear face of the case.

9. The portable case of claim 1, wherein the portable handheld electronics device includes a portable phone.

10. The portable case of claim 1, wherein the cover further includes:

a slit opening through the bottom wall of the cover.

11. The portable case of claim 1, wherein the cover further includes:

a small opening through the rear face and the front face of the top section of the cover located above an upper left corner of the bottle opener.

12. A portable case for protecting a portable handheld electronic devices, comprising:

a cover having an upper half and bottom half, the cover having a front face and a rear face, the front face having a top wall and a bottom wall and a left side wall and a right side wall, the cover being sized and shaped for engaging and at least partially encasing a portable handheld electronic device, the portable handheld electronic device having a rear exterior face and a front exterior face and four sides with perimeter edges about the four sides, the cover for protecting the rear exterior face and the four sides and the perimeter edges of the portable handheld electronic device, the front face of the portable handheld electronic device being left open to be operable with the cover; and a bottle opener positioned within and permanently attached to the rear face of the upper half of the cover, such that the bottle opener is always exposed to be used from the rear face of the cover wherein the portable case is a separate component from the rear exterior wall of the portable handheld electronic device.

13. The portable case of claim 12, wherein the bottle opener partially protrudes beyond a planar surface of the rear face of the cover.

14. The portable case of claim 12, wherein the bottle opener includes:

a tab adapted for additionally opening a can tab on a beverage can.

15. The portable case of claim 12, further comprising:

sloping walls adjacent to the bottle opener.

16. The portable case of claim 15, wherein the sloping walls include:

thickened portions for reinforcing the bottle opener to the case.

17. The portable case of claim 12, further comprising:

a closed wall separating the bottle opener from the rear exterior wall of the portable handheld electronic device.

18. The portable case of claim 12, wherein the bottle opener is in a fixed position on the rear face of the case, and is operable as a bottle opener to remove caps from bottles in the fixed position on the rear face of the case.

19. The portable case of claim 12, wherein the cover further includes:

a slit opening through the bottom wall of the cover; and a small opening through the rear face and the front face of the top section of the cover located above an upper left corner of the bottle opener.

20. An accessory holder for portable handheld electronics devices, comprising;

a case having a front face and a rear face, the front face having a top wall and a bottom wall and a left side wall and a right side wall, the case being sized and shaped for engaging and at least partially encasing a portable handheld electronic device, the portable handheld electronic device having a rear exterior face and a front exterior face and four sides with perimeter edges about the four sides, the case for protecting the rear exterior face and the four sides and the perimeter edges of the portable handheld electronic device, the front face of the portable handheld electronic device being left open to be operable with the case; and a bottle opener fixed to and permanently attached within an upper section of the rear face of the case, such that the bottle opener is always exposed to be used from the rear face of the cover wherein the accessory holder is a separate component from the rear exterior wall of the portable handheld electronic device.

* * * * *